US008317391B2

(12) United States Patent
Conus et al.

(10) Patent No.: US 8,317,391 B2
(45) Date of Patent: Nov. 27, 2012

(54) DEVICE FOR PIVOTING AN ARBOUR IN A TIME PIECE

(75) Inventors: Thierry Conus, Lengnau (CH); Jean-Luc Helfer, Bienne (CH)

(73) Assignee: Eta Sa Manufacture Horlogère Suisse, Grenchen (CH)

( * ) Notice: Subject to any disclaimer, the term of this patent is extended or adjusted under 35 U.S.C. 154(b) by 397 days.

(21) Appl. No.: 12/596,947

(22) PCT Filed: Apr. 24, 2008

(86) PCT No.: PCT/EP2008/055009
§ 371 (c)(1),
(2), (4) Date: Jan. 22, 2010

(87) PCT Pub. No.: WO2008/132135
PCT Pub. Date: Nov. 6, 2008

(65) Prior Publication Data

US 2011/0164478 A1 Jul. 7, 2011

(30) Foreign Application Priority Data

Apr. 26, 2007 (EP) ..... 07106986

(51) Int. Cl.
*G04B 35/00* (2006.01)

(52) U.S. Cl. ..... 368/326; 384/295

(58) Field of Classification Search ..... 368/324–326; 384/261, 295, 275–276
See application file for complete search history.

(56) References Cited

U.S. PATENT DOCUMENTS

| | | | | | |
|---|---|---|---|---|---|
| 1,236,175 | A | * | 8/1917 | Hopewell | 368/326 |
| 1,310,038 | A | * | 7/1919 | Stewart | 368/326 |
| 1,546,075 | A | * | 7/1925 | Horn | 368/324 |
| 1,843,868 | A | * | 2/1932 | Copelin | 384/246 |
| 1,907,792 | A | * | 5/1933 | Greenleaf | 384/246 |
| 2,233,743 | A | * | 3/1941 | Marti | 368/324 |
| 2,372,972 | A | * | 4/1945 | Morf | 368/326 |
| 2,654,990 | A | * | 10/1953 | Le Van | 368/324 |
| 2,849,855 | A | * | 9/1958 | Seitz | 368/324 |

(Continued)

FOREIGN PATENT DOCUMENTS

CH 324 263 A 9/1957

(Continued)

*Primary Examiner* — Sean Kayes
(74) *Attorney, Agent, or Firm* — Sughrue Mion, PLLC

(57) ABSTRACT

The device for pivoting an arbour (11) in a timepiece, includes two pivots (12, 12'; 32) each forming one end of the arbour and two bearings for receiving the two pivots. Each of the pivots includes an approximately cylindrical portion (19, 19'; 39) and a convex rounded portion (13, 13'; 33) that extends the approximately cylindrical portion and gradually decreases in the direction of the end. Each of the bearings includes a pivoting structure (25; 35) held in place elastically, which includes an approximately cylindrical passage traversed by said approximately cylindrical portion (19, 19'; 39) of one of the pivots. The pivoting structure also includes a bearing surface against which the end of said pivot will abut. The pivoting device is characterized in that the pivoting structure of each of the bearings includes an aperture (16, 16'; 36; 46) that has a portion of inverted triangular or trapezoidal profile (16, 16'; 38; 46), and in that the convex rounded portion (13, 13'; 33) of one of the two pivots is for abutting against said inclined inner wall so that the arbour (11) is held axially between the inclined walls of the apertures of the two bearings.

10 Claims, 5 Drawing Sheets

U.S. PATENT DOCUMENTS

| | | | | | |
|---|---|---|---|---|---|
| 2,920,441 | A | * | 1/1960 | Fiechter | 368/324 |
| 2,970,017 | A | * | 1/1961 | Zaslawsky | 384/225 |
| 3,012,828 | A | * | 12/1961 | Matthey | 384/225 |
| 3,036,871 | A | * | 5/1962 | Matthey | 384/225 |
| 3,047,346 | A | * | 7/1962 | Loretan | 384/225 |
| 3,080,703 | A | * | 3/1963 | Body | 368/324 |
| 3,098,681 | A | * | 7/1963 | Kohlhagen et al. | 384/440 |
| 3,306,027 | A | * | 2/1967 | Schneider | 368/326 |
| 3,942,848 | A | * | 3/1976 | Voumard | 384/125 |
| 2004/0195209 | A1 | | 10/2004 | Aoshima | |

FOREIGN PATENT DOCUMENTS

| | | | |
|---|---|---|---|
| CH | 339 134 | A | 6/1959 |
| EP | 1 217 471 | A1 | 6/2002 |

* cited by examiner

DEVICE FOR PIVOTING AN ARBOUR IN A TIME PIECE

CROSS REFERENCE TO RELATED APPLICATIONS

This application is a National Stage of International Application No. PCT/EP2008/055009 filed Apr. 28, 2008, claiming priority based on European Patent Application No. 07106986.8 filed Apr. 26, 2007, the contents of all of which are incorporated herein by reference in their entirety.

The present invention concerns devices for pivoting an arbour in a timepiece, which include two pivots that each form one end of the arbour, and two bearings for receiving the two pivots, each of the two pivots having, close to the end, an approximately cylindrical portion and a convex, rounded portion that continues the approximately cylindrical portion and tapers gradually in the direction of the end. Each of the two bearings has a pivoting structure held in place elastically, and the pivoting structure includes an approximately cylindrical passage traversed by the approximately cylindrical portion of one of the pivots and a bearing surface against which the end of said pivot abuts.

FIGS. 13-51 and 13-52 of page 291 of the work, "Théorie d'horologerie", show one half of an anti-shock pivoting device for a balance staff that answers the above definition. The pivot shown, which forms one of the ends of a balance staff, has a pointed shape and ends in a cylindrical part with a slightly rounded end. Pivoting is achieved by a jewel hole and an endstone, which are held in a setting to form a pivoting structure. The jewel hole forms an approximately cylindrical passage that surrounds the cylindrical portion of the pivot so as to retain the balance staff radially. The endstone forms a bearing surface against which the rounded end of the pivot will abut. The setting is secured in place elastically.

The example pivoting device shown in FIG. 5 of CH Patent No. 324,263 also answers the above definition. The pivot shown in FIG. 5 ends in a cylindrical part with a slightly rounded end. Pivoting is achieved via a single jewel pierced with a blind hole with cylindrical walls. This jewel is mounted in a setting and forms therewith a pivoting structure. The cylindrical part of the pivot is engaged in the hole with cylindrical walls, and the rounded end of the pivot can thus abut against the bearing surface formed by the flat bottom of the blind hole. Moreover, as illustrated by FIG. 1, the pivoting structure is elastically secured in place in a housing with a conical base of a bearing body, which is itself secured to the bottom plate.

There are some drawbacks to the pivoting devices of the prior art that have just been described. In particular, the contact zone of each pivot with the corresponding bearing changes depending upon the inclination of the timepiece. When the timepiece is in a horizontal position, the balance staff is thus oriented vertically, and only the rounded end of one of the pivots abuts against the bearing surface, whereas when the timepiece is in a vertical position, it is the circumference of the cylindrical part of the pivots that rests against the flank of the approximately cylindrical passages. It will be clear that, in such conditions, there is less braking due to friction when the timepiece is in a flat position than in other positions. This phenomenon influences the balance oscillations, and amplitude variations may in turn, cause rate variations between the horizontal position and the vertical position.

It is thus an object of the present invention to provide a device for pivoting a balance staff wherein amplitude variations between the various positions of the watch are reduced to a minimum. The invention achieves this object by providing a device in accordance with claim 1.

According to the present invention, each pivot abuts against the inclined inner wall of the portion with a trapezoidal profile (the "profile" of an aperture means the shape of the contour of that aperture when the latter is seen in cross-section along a plane that contains the aperture axis, or along a plane which contains the rotational axis of the balance, which is approximately the same thing). Thus, the end of the pivot cannot penetrate as far as the bottom of the aperture. The pivot therefore never abuts forwards against the bearing surface. Even when the balance staff is oriented vertically, abutment does not occur via the tip of the pivot, but only via the sides of the rounded portion thereof. In such conditions, it is possible to provide a pivoting device wherein the friction force torque varies very little between the various possible orientations of the timepiece.

The diameter of the rounded portion whose sides abut against the tapered edge of an aperture is preferably between approximately 0.05 and 0.10 mm.

The wall of the portion with an inverted triangular or trapezoidal profile preferably has an inclination relative to the balance staff of between approximately 40° and 60°.

According to a first embodiment of the present invention, the pivoting structure of each of the two bearings includes an axial stop element (15, 15') in which said aperture (16, 16') of circular or polygonal section is arranged, and a radial guide element (21, 21') traversed by the approximately cylindrical passage.

This first embodiment is similar to pivoting devices of the prior art which associate jewel holes and endstones. However, the axial stop element according to the invention differs from known endstones in that it has an aperture for receiving the convex, rounded portion of a pivot.

According to an advantageous embodiment of this first embodiment, each of the stop elements in which the aperture is made is formed by a single crystal, the aperture itself being made by wet anisotropic etching the single crystal.

According to a second embodiment of the present invention, a cylindrical walled portion of the aperture of circular or polygonal section forms the approximately cylindrical passage of the pivoting structure, the cylindrical walled portion being located between the portion with an inverted triangular or trapezoidal profile and the mouth of the aperture.

This second embodiment is termed "single-piece" because the approximately cylindrical passage and the bearing surface are made in the same aperture of the pivoting structure. This embodiment of the present invention is slightly reminiscent of the pivoting device disclosed in the aforementioned CH Patent No. 324,263. However, it differs from that prior art in that the bottom of the aperture is not flat but has an inclined wall.

Other features and advantages of the present invention will appear upon reading the following description, given solely by way of non-limiting example and made with reference to the annexed drawings, in which.

Figure 3:
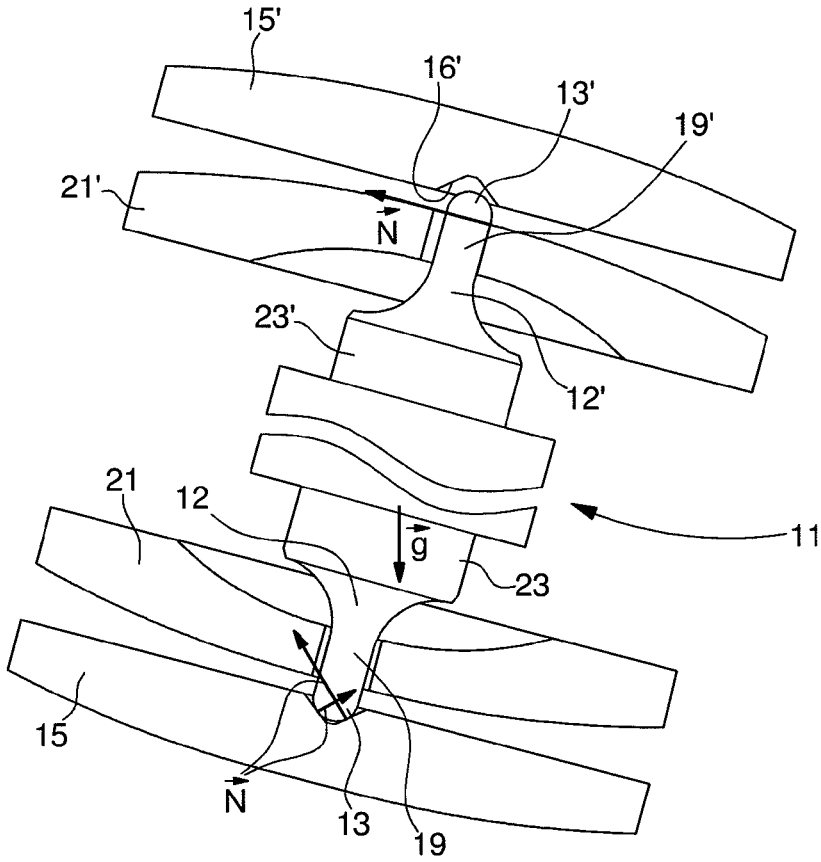
FIG. 3 is a schematic cross-section showing the same elements as FIG. 3, but in which the axis of the balance staff is inclined relative to the vertical.

FIG. 3 shows schematically a balance staff 11 with its pivoting device. The ends of staff 11 form two pivots with rounded tips (respectively referenced 12 and 12'). It can also be seen that balance staff 11 is held radially by two radial guide elements (21, 21') and axially by two axial stop elements 15, 15' against which pivots 12, 12' can abut.

Figure 1:
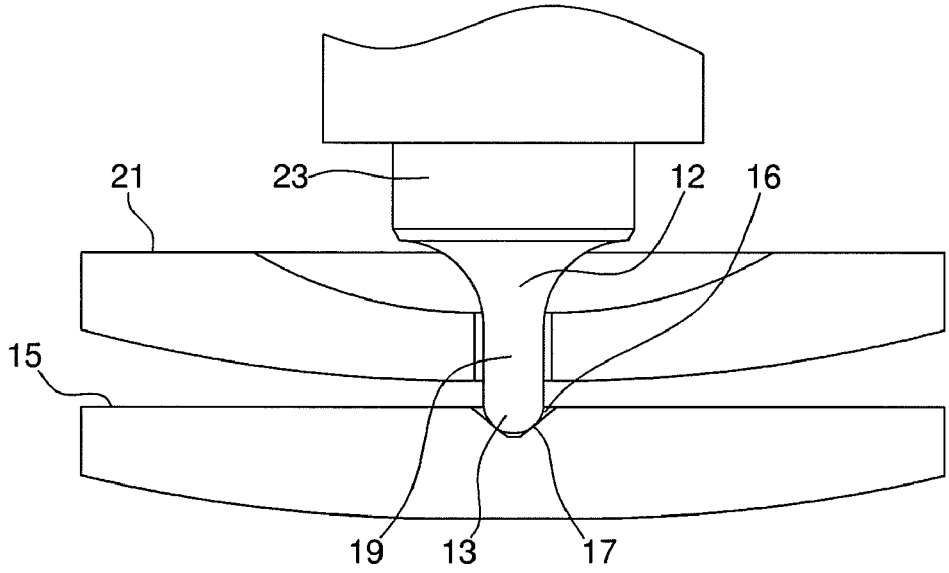
FIG. 1 is a schematic cross-section showing a pivot inserted in a radial guide element and an axial stop element in accordance with the present invention.

FIG. 1 shows one half of the same pivoting device oriented vertically. FIGS. 1 and 3 show that, in the example shown, the tip of pivot 12 ends in a rounded portion 13 that approximately forms a semi-sphere. The diameter of the sphere may advantageously be comprised between 0.05 and 0.10 mm, for example approximately 0.07 mm. The end 13 of pivot 12 is for abutting against the inner wall 17 of an aperture of trapezoidal section (referenced 16 in FIG. 1), formed in an axial stop element 15. It can be seen that aperture 16 has the shape of a cone approximately coaxial with the axis of balance staff 11. The aperture of cone 16 is preferably comprised between approximately 80° and 120° or, in other words, the inclination of wall 17 relative to the axis of balance 11 is preferably comprised between 40° and 60°. FIGS. 1 and 3 also show that the rounded portion 13 and aperture 16 are sized such that the lateral surface of rounded portion 13 is entirely supported by inclined wall 17.

In FIG. 3, two arrows (referenced N) represent the perpendicular direction to the contact surface between pivot 12 and axial stop element 15. The place of origin of the two arrows N is at a contact point. It will be noted that the contact surfaces are not uneven, which allows abutment perpendicular to the surfaces. In other words, at the point of abutment of pivot 12 on the wall of aperture 16, the direction of arrow N corresponds both to the normal direction to the pivot surface and the normal direction to the inclined wall of the aperture.

According to the present invention, pivot 12 does not abut against the bottom of aperture 16, but against the inclined inner wall thereof. In fact, as the axis of aperture 16 is approximately parallel to the axis of pivot 12, the contact of pivot 12 with the inside of aperture 16 occurs via the sides of the pivot, in a surface area of the latter whose inclination is the same as that of the cone walls; i.e. approximately 50% in the present example. Moreover, if we compare FIGS. 1 and 3, we can see that it is approximately the same surface area of the pivot that ensures contact when the balance staff is horizontal and when the staff is inclined.

FIGS. 1 and 3 also show that pivots 12, 12' include an elongated cylindrical part 19, 19', which precedes the rounded end 13, 13'. The elongated cylindrical part passes in the olive-cut or cylindrical hole of a radial guide element 21, 21'. The function of the radial guide element corresponds to the function of a jewel hole in a usual pivoting device. Further, in a pivoting device according to the present invention, the radial guide element 21, 21' prevents the rounded end 13, 13' of the pivot from being completely released from aperture 16, 16'. Indeed, referring more specifically to FIG. 3, it can be seen that there is some play, both radial and axial, between balance staff 11 and the axial stop elements 15 and 15'. It will be specified however that, in the Figure, the amplitude of this play has been exaggerated to aid comprehension. Because of the axial play, when balance staff 11 is vertical or approximately inclined as in FIG. 3, the top end 12' is no longer in contact with axial stop element 15'. In this situation, elongated cylindrical part 19' will abut against the inner wall of the approximately cylindrical passage in radial guide element 21'. In FIG. 3, the perpendicular direction to the contact surface between pivot 12' and radial guide element 21' is represented by an arrow (again reference N). Arrow N starts at the location of a point of contact. Finally, in the case that is not shown where the balance staff is approximately horizontal, it will be clear that cylindrical parts 19, 19' will both abut against the inner wall of the approximately cylindrical passage of one of radial guide elements 21, 21'. Thus the contact of a pivot with the radial guide element always occurs via the sides of the pivot.

As the radial guide element and the axial stop element form, according to the present invention, part of a pivoting structure that is held in place elastically, the play between balance staff 11 and axial stop elements 15 and 15' may become temporarily much greater in the event of a shock. This elastic suspension of the pivoting structure is, in a known manner, provided to prevent cylindrical portion 19 from breaking in the event of a shock. Thus, balance staff 11 has another pivot-shank (referenced 23 in FIG. 1) that is considerably thicker than cylindrical portion 19. Because of its dimensions, pivot-shank 23 is much more solid than the end of a pivot 12, 12', and it is provided for abutting against a part of the device that is not shown, so as to absorb the greater part of the energy associated with the shock.

Figure 2:
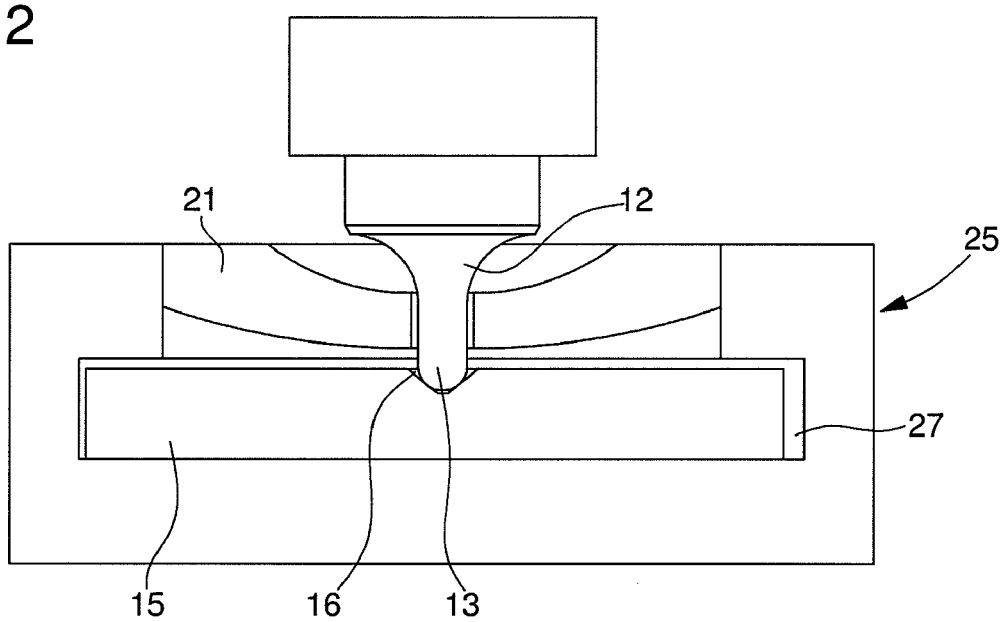
FIG. 2 is a partial cross-section showing schematically a pivoting structure of a pivoting device according to a first embodiment of the present invention.

FIG. 2 is a partial cross-section showing schematically a pivoting structure of a pivoting device according to a first embodiment of the present invention (those elements of FIG. 2 also shown in FIGS. 1 and 3 keep the same reference numerals). The Figure shows that the two jewels respectively forming the axial stop element 15 and the radial guide element 21 are both mounted in a setting (schematically shown) with which they form pivoting structure 25.

There may be some difficulties in making pivoting structure 25. In fact, it will easily be understood that it is important that the axis of aperture 16 and that of the approximately cylindrical passage of radial guide element 21 are perfectly aligned. Indeed, since the diameter of the pivot is of the order of 0.1 mm, a shift of less than a hundredth of a millimetre between the axes of the two apertures is sufficient to considerably affect pivoting quality.

FIG. 2 shows that axial stop element 15 is housed in a cylindrical cavity 27. The diameter of cavity 27 is slightly greater than that of the axial stop element. The latter thus enjoys some lateral play. When the balance staff is in a vertical position, as shown in FIG. 2, the rounded portion 13 of the pivot tip abuts against the inclined side of aperture 16 of element 15. If, for one reason or another, aperture 16 is not entirely aligned with the balance axis, the abutment of the pivot tip on the inclined edge only occurs on one side of the aperture. In such conditions, the thrust of the pivot on the edge of the aperture is exerted asymmetrically, and the horizontal component of the thrust is sufficient to bring axial stop element 15 back within the balance staff axis. It will thus be understood that the inclined wall of aperture 16 allows axial stop element 15 to centre itself.

Depending upon the circumstances, it may be preferable for the axial stop element to be rigidly secured in the pivoting structure. The solution to alignment problems that has just been described may be adapted to this situation. In fact, it is possible to precisely adjust the alignment of axial stop element 15 at the assembly stage of pivoting structure 25. In order to do this, a "false arbour" is first of all inserted in pivoting structure 25 in the place provided for the balance staff. The thrust of this "false arbour" enables axial stop element 15 to be centred in accordance with an identical principle to that explained in the preceding paragraph. Once aperture 16 of axial stop element 15 has been brought perfectly within the axis, a step of securing this element to the rest of pivoting structure 25 by bonding, welding or any other method know to those skilled in the art, is performed. It is preferably only once the "false arbour" has been removed, and the axial stop element secured, that pivoting structure 25 is positioned in the watch.

Figure 4:
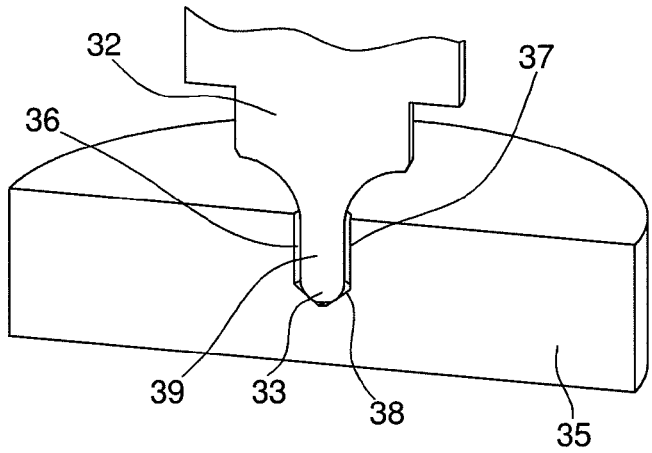
FIG. 4 is a partial cross-section showing schematically a pivoting structure of a pivoting device according to a second embodiment of the present invention.

FIG. 4 is a partial cross-section schematically showing a pivoting structure for a pivoting device according to a second embodiment of the present invention. The half device shown comprises a pivot 32 similar to pivot 12 of FIGS. 1, 2 and 3. It has a tip with an elongated cylindrical portion 39 and ends in a rounded portion 33. The tip of pivot 32 is inserted in an aperture 36 of a pivoting structure 35. The Figure shows that the profile of aperture 36 has a first portion with a cylindrical wall 37, followed by a portion of trapezoidal profile 38. The rounded tip 33 of the pivot is sized such that its rounded surface can abut against the inclined wall of the portion of trapezoidal profile 38. It can also be seen that the cylindrical portion 39 of pivot 32 extends inside the portion with cylindrical walls 37 of aperture 36. Indeed, the inner wall of portion 37 is provided for surrounding cylindrical portion 39 of pivot 32 so as to retain the balance staff radially. It will thus be clear that, in the embodiment of the invention shown in FIG. 4, a single-piece pivoting structure 35 fulfils both the function of axial stop element and radial guide element for pivot 32. In comparison with the embodiment of FIGS. 1, 2 and 3, it can be said that the embodiment of FIG. 4 unites elements 15 and 21 in a single piece. Single-piece element 35 is suitable to be made for example of metal or an alloy, or even of plastic material. If one wishes to make element 35 in a metal or alloy, it is possible to use photolithography and galvanic growth, and particularly to implement the RIGA technique.

It is important to specify also that the section of apertures 16, 16' and 36 is not necessarily circular. Indeed, as will be seen in the example shown in FIGS. 5 and 6 and which will now be described, the section of an aperture may also be polygonal (the "section" of an aperture means the shape of the contour of the aperture when it is see in transverse cross-section to the aperture axis or, which is approximately the same thing, transverse to the rotational axis of the balance).

Figure 7:
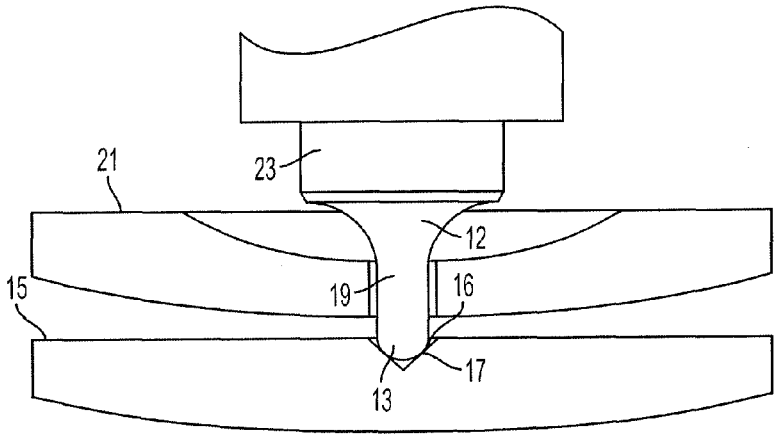
FIG. 7 is a cross-section showing the alternative triangular profile of the aperture.

According to an advantageous variant of the present invention, the axis stop elements 15 shown in FIGS. 1 to 3 can be made from a wafer of single crystalline material, such as silicon for example. Indeed, the known method of liquid (or wet) medium anisotropic etching is an advantageous way of forming polygonal apertures of triangular (See, FIG. 7) or trapezoidal profile in single crystalline wafers.

Figure 8A:
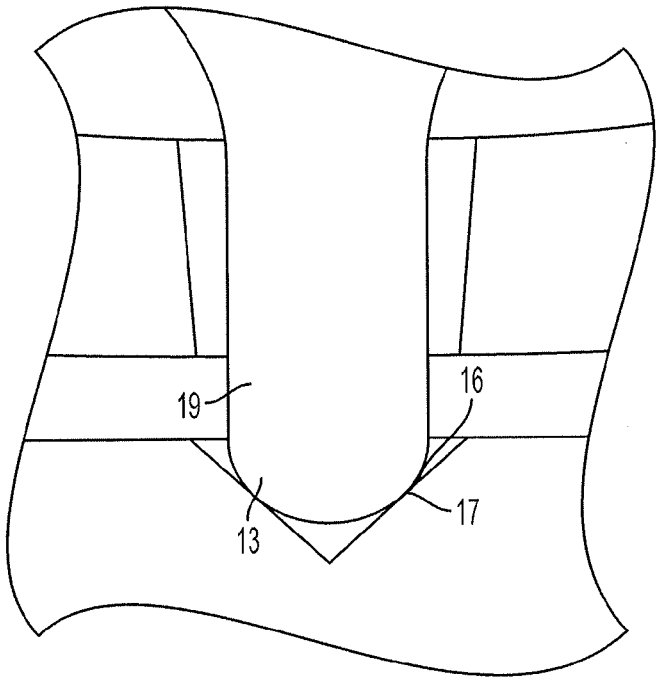
FIGS. 8A and 8B are exploded views of the approximately cylindrical passage of the radial guide element.
Figure 8B:
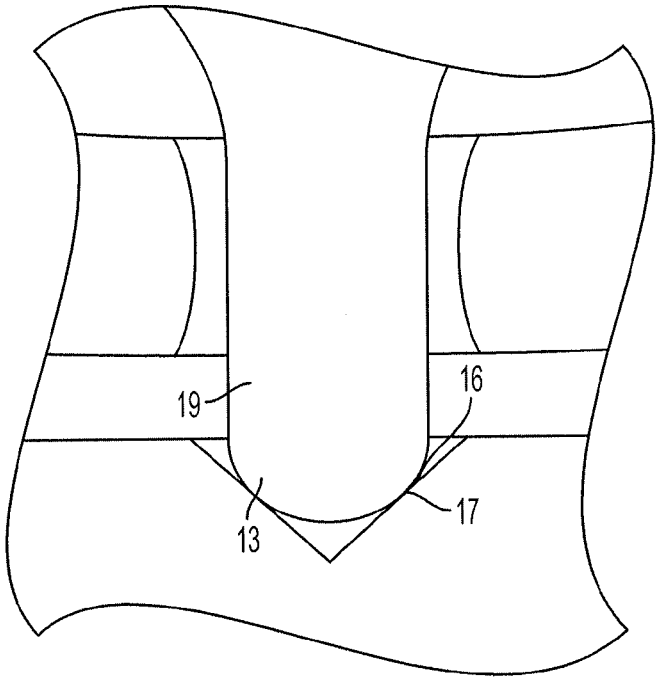

FIGS. 8A and 8B show different shapes of the approximately cylindrical passage of the radial guide element.

Etching, or more precisely, chemical etching of a single crystal is called anisotropic if the etching speed is higher in some crystallographic directions than in others. The etch anisotropy depends upon numerous parameters. First of all, it depends upon the interaction between the chemical properties of the substance forming the single crystal and those of the etch reagent used. Moreover, the etch speeds in different crystallographic directions depend, of course, upon the symmetry of the crystalline structure. By varying the concentration of reagent, temperature etc., it is thus possible to make polygonal apertures with relatively complex profiles in a single crystal.

A known wet anisotropic etch example concerns silicon. It is possible to form apertures in the shape of inverted pyramids in a silicon wafer with an orientation of <100> by wet etching. US Patent No. 2004/0195209, which is incorporated in this Application by reference, discloses one such method that can be implemented to make these inverted pyramid-shaped apertures.

Figure 5:
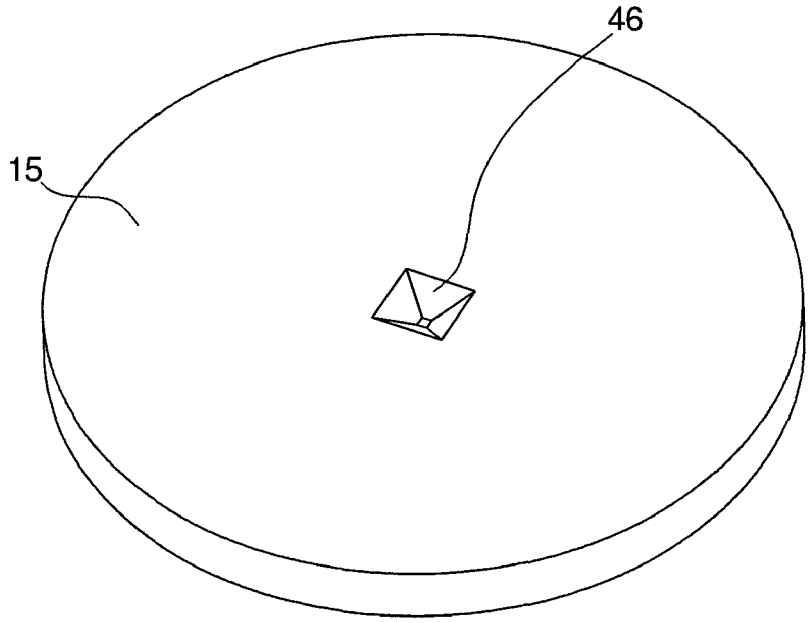
FIG. 5 is a perspective view of an axial support element according to the invention, which may be obtained from a silicon wafer.
Figure 6:
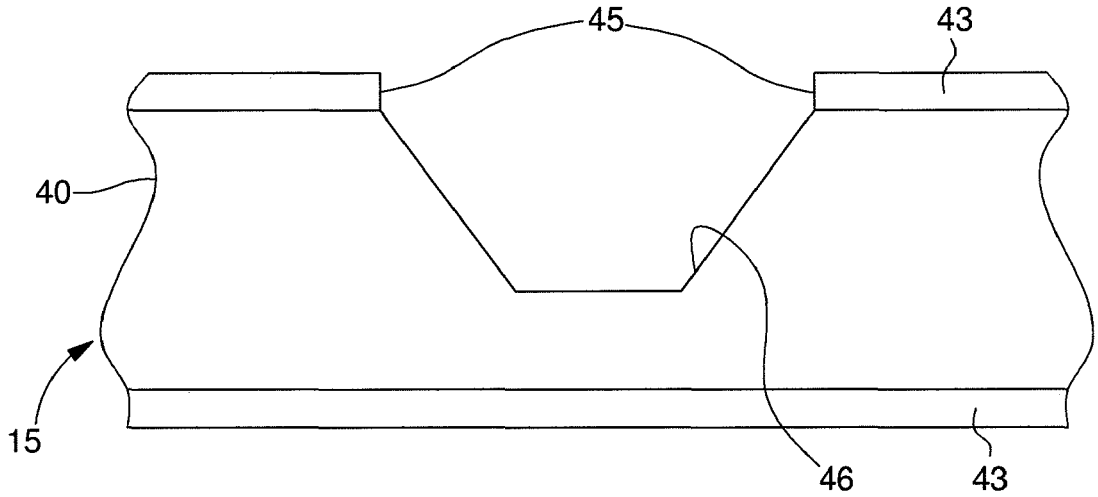
FIG. 6 is a cross-section of the silicon wafer from which the axial support element of FIG. 5 may be obtained.

FIG. 5 shows the axial stop element 15 of a bearing for a pivoting device made from a single crystal silicon wafer 40 with an orientation of <100>. In FIG. 6, the wafer is shown covered by a mask 43. This mask must be formed on the wafer surface prior to performing the etch, so as to protect the silicon from the etching reagent. The mask has an aperture 45 formed at the location where aperture 46 has to be etched in the silicon. During the etch, the etching reagent makes a pyramid-shaped aperture. Depending upon the exact nature of the reagent used, the inclined faces of the pyramid may either be <110> planes, or <111> planes. Whether the pyramid faces are <110> planes, or <111> planes, the pyramid has a square section. Indeed, the directions <110> and <111> both have order 4 rotational symmetry.

In this example, the inverted pyramid forming aperture 46 is slightly truncated (FIG. 6). However, it will be clear that this is not necessarily the case. Moreover, the inclination of planes <110> is approximately 45°, and that of <111> planes is approximately 55°. Thus, as was seen above, according to an advantageous feature of the present invention, the edges of the trapezoidal portion of an aperture have an inclination of between 40° and 60°. The wet anisotropic etch is thus particularly well suited to the present invention.

It will be clear that various alterations and/or improvements evident to those skilled in the art may be made to one or other of the embodiments described without departing from the scope of the present invention defined by the annexed claims. In particular, the present invention is not limited to a pivoting device for a balance staff. On the contrary, the pivoting device of the present invention could be used for any staff or arbour of the timepiece and, particularly, for pivoting the escapement or lever. Moreover, the pivoting device according to the present invention could be made from materials other than conventional materials or silicon. Indeed, the invention could be achieved from any material that those skilled in the art deem suitable for use.

In particular, it is known to make apertures by wet anisotropic etching in single gallium arsenide or indium phosphide crystals. It is useful to specify that these apertures differ from those described in the preceding example in that they may have the form of inverted tetrahedrons (of triangular section) instead of inverted pyramids. Generally, in accordance with the annexed claims, the section of the apertures may be circular or polygonal, and if the section is polygonal, the polygon may have any number of sides.

The invention claimed is:

1. A pivoting device for an arbour in a timepiece, including two pivots each forming one end of the arbour and two bearings for receiving the two pivots, each of the two pivots including, close to the end, an approximately cylindrical portion and a convex rounded portion that continues the approximately cylindrical portion and gradually tapers in the direction of the end, each of the two bearings including a pivoting structure held in place elastically, the pivoting structure including an approximately cylindrical passage traversed by said approximately cylindrical portion of one of the pivots and a bearing surface against which the end of said pivot will abut, wherein the pivoting structure of each of the two bearings includes an aperture of circular or polygonal section, said aperture having a portion of inverted triangular or trapezoidal profile whose inclined, inner wall forms said bearing surface, and wherein said convex rounded portion of one of the pivots is for abutting against said inclined inner wall so that the arbour is held axially between the inclined walls of the apertures of the two bearings.

2. The pivoting device according to claim 1, wherein the radius of curvature of the convex rounded portion is comprised between approximately 0.025 and 0.5 mm.

3. The pivoting device according to claim 1, wherein the inner edge of the trapezoidal profile portion has an inclination relative to the axis of the arbour of between approximately 40° and 60°.

4. The pivoting device according to claim 1, wherein the pivoting structure of each of the two bearings includes an axial stop element in which said aperture of circular or polygonal section is arranged, and a radial guide element through which the approximately cylindrical passage passes.

5. The pivoting device according to claim 4, wherein the axial stop element is mounted in the pivoting structure with some lateral play relative to the axis of the arbour to enable the aperture to be aligned with the approximately cylindrical passage of the radial guide element.

6. The pivoting device according to claim 4, wherein the two axial stop elements are each formed by a single silicon crystal, and wherein the aperture in each of the axial stop elements is made by wet anisotropic etching the single crystal.

7. The device according to claim 6, wherein the aperture in each axial stop element is an aperture of square section.

8. The pivoting device according to claim 1, wherein the approximately cylindrical passage is formed by a cylindrical walled portion of said aperture of circular or polygonal section, said cylindrical walled portion being located between the portion of inverted triangular or trapezoidal profile and a mouth of the aperture.

9. The pivoting device according to claim 8, wherein the pivoting structure is made of plastic.

10. The pivoting device according to claim 8, wherein it is made of metal or an alloy.

* * * * *